US008057221B2

(12) United States Patent
Rangmark et al.

(10) Patent No.: US 8,057,221 B2
(45) Date of Patent: Nov. 15, 2011

(54) METHOD AND BURNER FOR BURNING WITH OXYGEN

(75) Inventors: Lennart Rangmark, Älvsjö (SE); Tomas Ekman, Saltsjö-Boo (SE)

(73) Assignee: AGA AB, Lidingö (SE)

( * ) Notice: Subject to any disclaimer, the term of this patent is extended or adjusted under 35 U.S.C. 154(b) by 1089 days.

(21) Appl. No.: 11/508,746

(22) Filed: Aug. 23, 2006

(65) Prior Publication Data

US 2007/0298356 A1 Dec. 27, 2007

(30) Foreign Application Priority Data

Jun. 22, 2006 (SE) ..... 0601374

(51) Int. Cl.
*F23C 7/00* (2006.01)
*F23N 1/02* (2006.01)

(52) U.S. Cl. ..... 431/181; 431/8; 431/187; 431/112; 431/10; 431/5; 110/341

(58) Field of Classification Search ..... 431/181, 431/8, 10, 9, 187, 280, 278, 174, 178; 110/341
See application file for complete search history.

(56) References Cited

U.S. PATENT DOCUMENTS 3,685,740 A * 8/1972 Shepherd ..... 239/400
4,511,325 A * 4/1985 Voorheis ..... 431/10
4,969,814 A * 11/1990 Ho et al. ..... 431/8
5,076,779 A * 12/1991 Kobayashi ..... 431/5
5,112,219 A * 5/1992 Hiemstra ..... 431/354
5,129,333 A * 7/1992 Frederick et al. ..... 110/235
5,772,421 A * 6/1998 Besik et al. ..... 431/8
5,803,725 A * 9/1998 Horn et al. ..... 431/187
6,672,859 B1 * 1/2004 Rabovitser et al. ..... 431/9
6,755,645 B2 * 6/2004 Seo et al. ..... 431/353

FOREIGN PATENT DOCUMENTS

WO WO 2006/031163 A1 3/2006

* cited by examiner

*Primary Examiner* — Steven B McAllister
*Assistant Examiner* — Nikhil Mashruwala
(74) *Attorney, Agent, or Firm* — Alfred J. Mangels

(57) ABSTRACT

A method and a burner for combustion in a heating furnace of a fuel with an oxidant in the form of oxygen gas, wherein fuel and oxidant are supplied to a burner head. Fuel and oxidant, respectively, are injected via the burner head through at least two pairs of nozzles, wherein one nozzle pair is defined by a separate fuel nozzle and a separate oxidant nozzle. The nozzles of the nozzle pairs are uniformly distributed over the furnace-interior-facing surface of the burner and within the circumference of the burner head. An oxidant nozzle is provided on each side of a fuel nozzle.

12 Claims, 3 Drawing Sheets

METHOD AND BURNER FOR BURNING WITH OXYGEN

BACKGROUND OF THE INVENTION

1. Field of the Invention

The present invention relates to a method and to a burner for burning of oxygen, and more particularly for use with heating furnaces.

2. Description of the Related Art

Normally, when hydrocarbons are burned in combination with oxidants having a high oxygen content, flame temperatures within the furnace exceed 2000° C. and furnace atmospheres with very high partial pressures of carbon dioxide and water vapor are present. That condition also gives rise to drawbacks, such as high $NO_x$ content and problems of local overheating.

There is a strong desire to provide burners that have emission-lowering properties.

In Swedish patent application number 0402223-2, a method is disclosed for burning a fuel with an oxidant in a heating furnace, wherein the fuel and the oxidant are supplied to a burner head. According to that application, in a first step fuel and oxidant are discharged from the burner head close to each other, so that the combustion essentially takes place close to and up to a certain distance from the burner head. Combustion proceeds until a temperature exceeding the auto ignition temperature of the fuel is reached inside the furnace, after which the fuel and the oxidant, in a second step, are instead discharged from the burner head at a distance from each other. Consequently, the combustion essentially takes place at a distance from the burner head at least as large as the diameter of the burner head, and outwardly from the burner.

According to that application, the intent is to lower the oxygen content in the combustion zone through separation, high pressure, and optimized positioning of the nozzles, even though the oxidant has an oxygen content of more than 80%. That is accomplished by the use of a nozzle configuration that gives rise to a large underpressure over those surfaces of the nozzle that do not have nozzles for the medium. Because of the underpressure, flue gases are sucked in from the furnace atmosphere and are rapidly and turbulently mixed with the out-flowing media. The mixture medium, i.e., the furnace atmosphere, typically has an oxygen content of 0.5-10%. The remaining gas is $CO_2$, $H_2O$, and $N_2$ in various amounts.

Since the $CO_2$, $H_2O$, and $N_2$ do not actively take part in the combustion, those compounds act as a "combustion brake." The dilution of the oxygen and the fuel is very extensive, and oxygen rates during the combustion typically reach 7-15%, despite the use of pure oxygen gas.

The present invention is directed to overcoming those problems.

SUMMARY OF THE INVENTION

The present invention serves to further lower the $NO_x$ values, and also provides an even more uniform furnace interior temperature.

Thus, the present invention relates to a method and apparatus for the combustion of a fuel with an oxidant in the form of oxygen in a heating furnace, wherein fuel and oxidant are supplied to a burner head. Fuel and oxidant, respectively, are injected via the burner head through at least two pairs of nozzles, wherein one pair of nozzles is defined by a separate fuel nozzle and a separate oxidant nozzle. The nozzles of the nozzle pairs are uniformly distributed along and within the circumference of the burner head, and one of the fuel nozzles is provided with an oxidant nozzle at each side of the fuel nozzle.

BRIEF DESCRIPTION OF THE DRAWINGS

The invention is described in greater detail below, partly in connection with embodiments of the invention shown in the appended drawings wherein.

DESCRIPTION OF THE PREFERRED EMBODIMENTS

The present invention concerns combustion in a heating furnace of a fuel with an oxidant, wherein the fuel and oxidant are supplied to a burner head. The burner head is secured in a furnace wall in a known fashion, so that the flame formed during combustion extends into the furnace interior.

Figure 1:
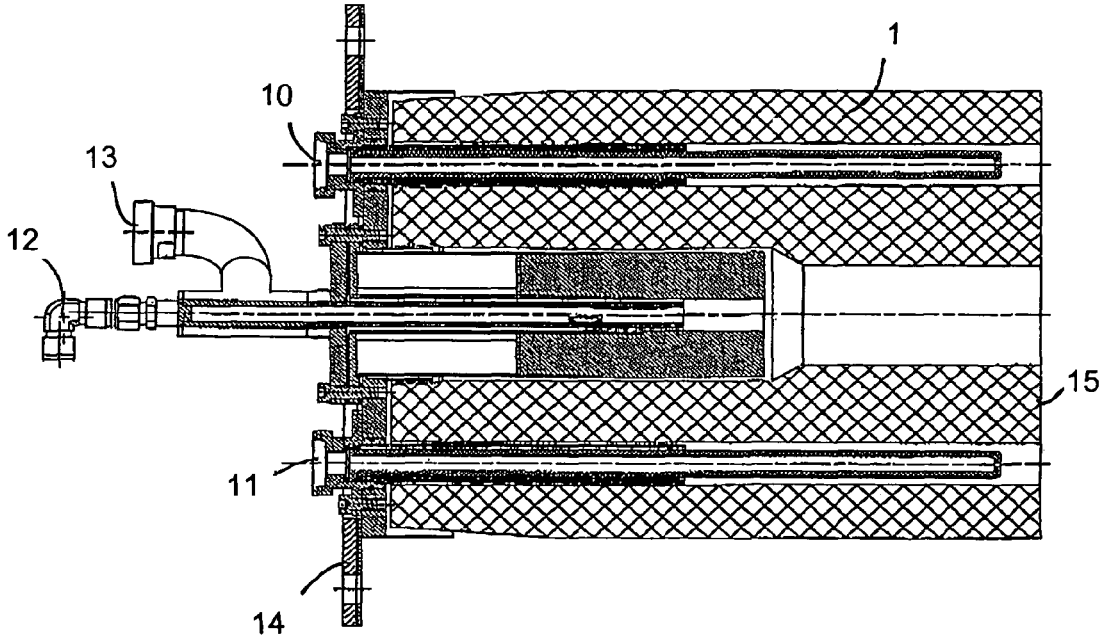
FIG. 1 is a longitudinal cross-sectional view of a burner head in accordance with a first embodiment of the present invention.
Figure 2:
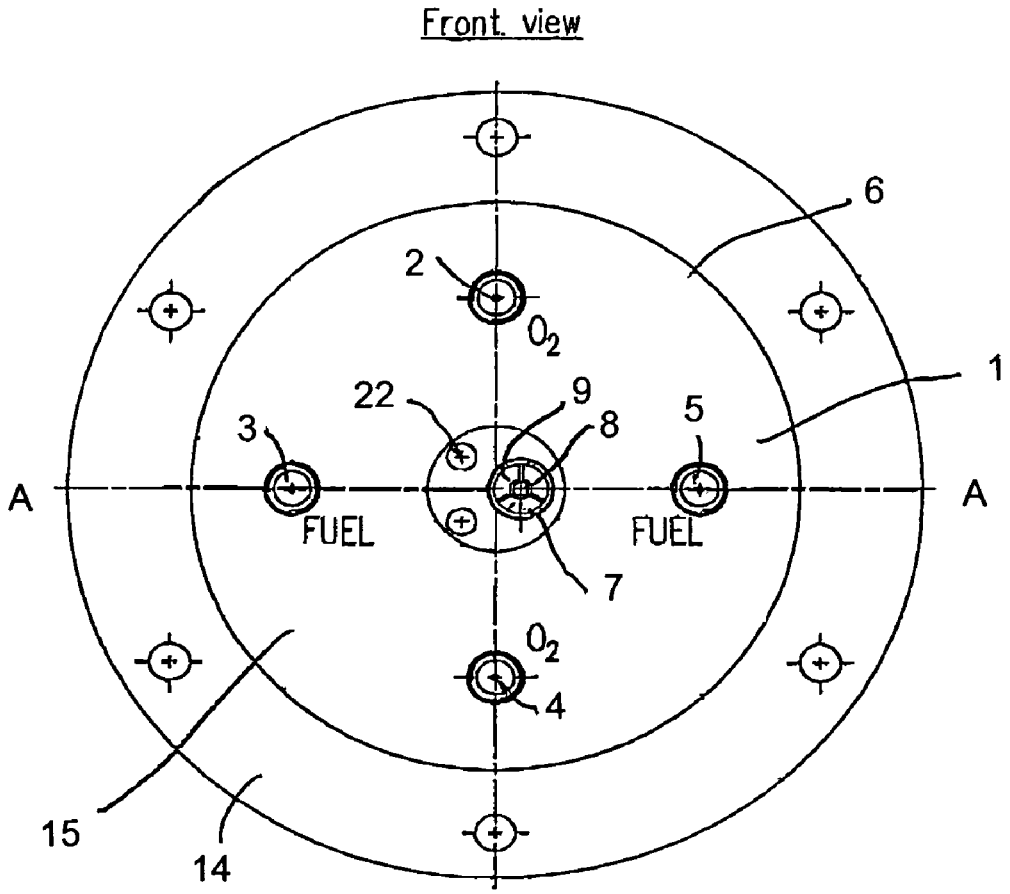
FIG. 2 is a front view of the burner head shown in FIG. 1.

Referring to the drawing, and particularly to FIGS. 1 and 2 thereof, fuel and oxidant, are injected into the interior of a furnace via the burner head 1 through at least two pairs of nozzles 2, 3, and 4, 5, wherein one nozzle pair is defined by a separate fuel nozzle and a separate oxidant nozzle, as labeled in FIG. 2. The nozzle pairs 2, 3, and 4, 5 are uniformly circumferentially and radially distributed over a burner surface that faces into the furnace, and lie within the outer circumference 6 of the burner head 1. Furthermore, each fuel nozzle 3, 5 is provided with an oxidant nozzle 2, 4 on each side of the respective fuel nozzle, as shown in FIG. 2.

FIG. 1 is a diagonal section through the burner head 1 taken along the line A-A of FIG. 2. As shown in FIG. 1, burner head 1 includes a pair of fuel supply inlets 10, 11, a central fuel supply conduit 12, and a central oxidant supply conduit 13. Reference numeral 14 denotes a flange for attaching the burner head to a furnace surface, and reference numeral 15 denotes the inner surface of the burner head that faces the interior of the furnace.

Figure 3:
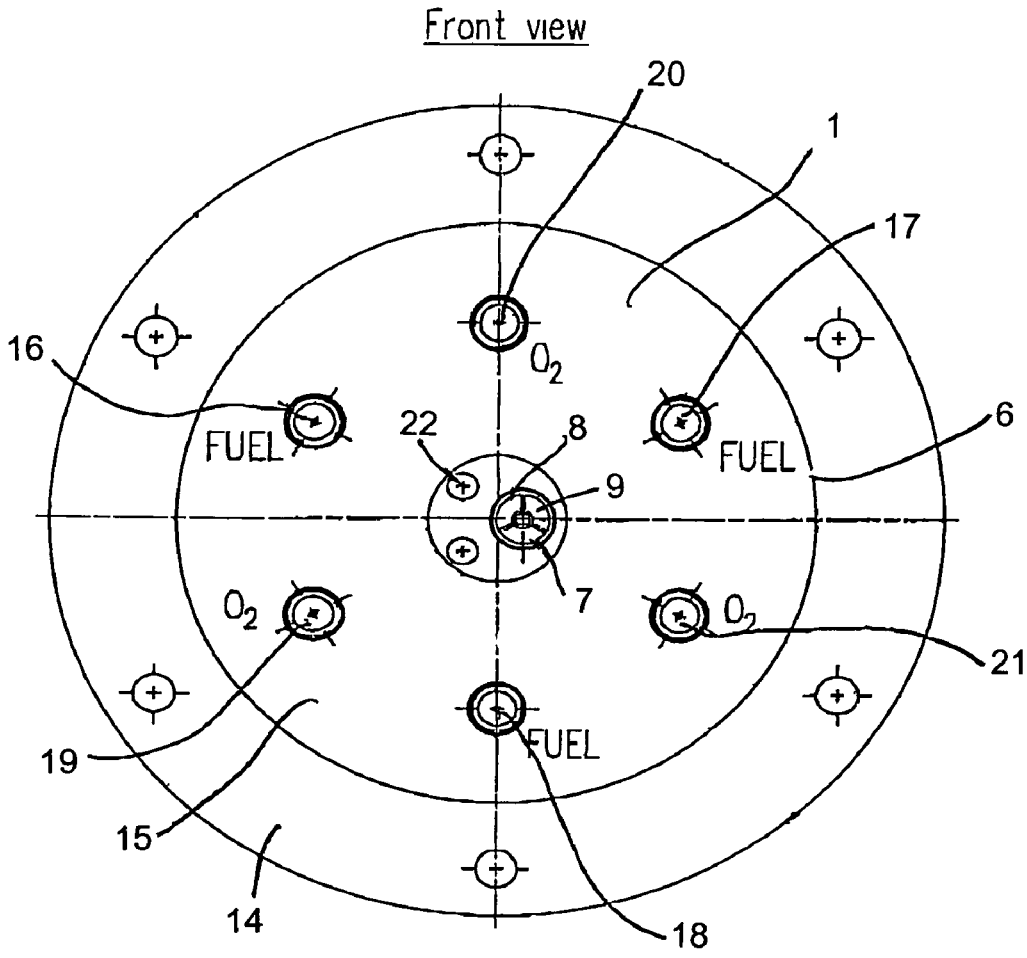
FIG. 3 is a front view of a burner head in accordance with a second embodiment of the invention.

A burner head having three pairs of fuel and oxidant nozzles is shown in FIG. 3.

According to the present invention, pairs of fuel nozzles and oxidant nozzles are provided, in contrast to the embodiment disclosed in the above-identified Swedish patent application, in which fuel is injected through one nozzle and the oxidant through a number of nozzles.

According to a preferred embodiment, the nozzles of the nozzle pairs shown and described herein are positioned along two mutually perpendicular diameters of the burner head, as shown in FIG. 2.

Surprisingly, it was found that by injecting the same amount of fuel and oxidant through a number of pairs of fuel and oxidant nozzles, instead of using one fuel nozzle and a plurality of oxidant nozzles, the production of $NO_x$ is lowered even further. At the same time, local concentrations of heat and coolness within the furnace are reduced. A probable explanation is that the pairing of nozzles results in the formation of several zones with heavy turbulence, as compared to a burner head wherein fuel is injected through only one fuel nozzle.

According to a preferred embodiment, the burner head 1 includes an additional nozzle 7, a starting nozzle, wherein fuel and oxidant are discharged through respective individual and concentric channels 8, 9. Starting nozzle 7 is operated until the temperature within the furnace has reached the auto ignition temperature for the particular fuel and oxidant combination.

According to a preferred embodiment, the starting nozzle 7 is positioned at or near the center of the burner head 1.

A second combustion step, during which fuel and oxidant are injected through respective ones of the paired nozzles, can advantageously be initiated when the temperature within the furnace is above about 750° C.

According to a preferred embodiment, the discharge openings of nozzles 2, 3, and 4, 5, are outlets of laval or venturi nozzles.

The opening 22 is to allow supervision of the flame by means of the detection of ultraviolet light.

In FIG. 3, an embodiment is shown having three fuel nozzles 16, 17, 18 and three oxidant nozzles, 19, 20, 21, and thus three nozzle pairs are provided in that embodiment.

Thus, the burner disclosed permits two different modes of operation: on one hand as a normal oxyfuel burner, and on the other hand as a burner whose operation results in a flame with a substantially lower maximum temperature. The lower flame temperature is adapted to be below the temperature at which the production of $NO_x$ is limited by the reaction kinetics, which is about 1550° C.

The lower flame temperature is accomplished by the use of the mentioned positioning of the paired nozzles for fuel and for oxygen, whereby fuel and oxygen gas are combusted further away from the burner head as compared to what is the case for conventional oxyfuel combustion.

When carrying out the invention, a diffuse yet controlled combustion is achieved at process temperatures above the auto ignition temperature, substantially lowering the production of nitrous gases, mainly NO and $NO_2$.

As a consequence, fuel and oxidant are mixed with flue gases of the furnace before the fuel and oxidant contact each other. In a way known per se, that results in a larger and cooler flame, in spite of the coefficient of utilization corresponding to combustion according to the prior art. Suitably, the nozzles can be directed straight ahead, that is, they do not need to be directed away from or toward each other. Instead, they can be angled toward or away from the longitudinal axis of the burner head.

According to a preferred embodiment, the oxidant is gaseous, and is an oxidant having an oxygen content of 85 vol % or above.

According to a principal feature of the invention, the oxidant is supplied to the burner at a pressure of at least 1 bar.

A normal pressure for normal applications is 4-5 bars.

The fuel is injected through normal nozzles at the available pressure.

A burner head according to the present invention is not larger than a known burner head for oxyfuel combustion. In a preferred embodiment, the burner head diameter is about 70 millimeters.

The compact structure provided by the present invention permits the invention to be applied to equipment already present at user premises. Also, the inventive structure can be positioned within a small, water-cooled protective jacket, for application at very high process temperatures.

According to the invention, the above-described advantages are achieved with any fuel, whether solid fuel, gaseous fuel, or liquid fuel. The apparatus according to the invention can replace existing combustion systems essentially without any reconstruction of the furnace equipment used in the process.

It is advantageous to choose as the fuel from among oil, propane, or natural gas.

Since the oxidant nozzles and the fuel nozzles can be directed straight ahead, a construction is achieved which is inexpensive, easy to maintain, and possible to apply to existing processes, and without any other measures other than exchanging the nozzle construction.

Several embodiments of the invention have been described herein. However, the design of the burner head can be varied, especially with respect to the number of pairs of fuel and oxidant nozzles.

Thus, the present invention should not be considered limited to the above-disclosed embodiments, but can be modified within the scope of the appended claims.

What is claimed is:

1. A method for combustion in a heating furnace of a fuel and an oxidant including gaseous oxygen, wherein the fuel and oxidant are supplied to a burner head, said method comprising the steps of: injecting fuel and oxidant via the burner head through at least two pairs of spaced apart nozzles, wherein each pair of nozzles is defined by a separate fuel nozzle for supplying only fuel and spaced therefrom a separate oxidant nozzle for supplying only oxidant, and wherein the separate and spaced apart fuel and oxidant nozzles have respective fuel and oxidant central axes and each of the fuel nozzle axes and each of the oxidant nozzle axes are spaced from each other and are each parallel to each other to cause both fuel and oxidant to flow from respective separate and spaced apart fuel and oxidant nozzles in the burner head and in the same direction relative to a burner head central axis; uniformly distributing spaced apart individual separate fuel only and individual separate oxidant only nozzles of the nozzle pairs over a burner head surface that faces into the furnace and within an outer circumference of the burner head, wherein the pairs of individual and separate fuel only and individual and separate oxidant only nozzles are uniformly alternately distributed in a circumferential direction relative to the burner head central axis and are uniformly radially distributed outwardly from the burner head central axis; and circumferentially positioning a separate oxidant nozzle on each side of a separate fuel nozzle, wherein the fuel only nozzles of the at least two pairs of spaced apart nozzles are not concentric with a flow of oxidant.

2. A method according to claim 1, including the steps of: providing an additional nozzle to serve as a starting nozzle, wherein fuel and oxidant are discharged through respective concentric channels provided in the starting nozzle; and supplying fuel and oxidant to the starting nozzle until the furnace has reached an autoignition temperature of a mixture of the fuel and the oxidant.

3. A method according to claim 1, including two pairs of nozzles, and the step of positioning respective fuel nozzles and respective oxidant nozzles of the nozzle pairs along two respective mutually perpendicular diameters of the burner head.

4. A method according to claim 2, including the step of positioning the starting nozzle adjacent the center of the burner head.

5. A method according to claim 1, including the step of providing a gaseous oxidant having an oxygen content of at least 80 vol %.

6. A method according to claim 5, wherein the oxidant is supplied at an overpressure of at least 1 bar.

7. A method according to claim 1, wherein the fuel is fuel oil.

8. A method according to claim 1, wherein the fuel is at least one of natural gas and propane.

9. A burner for combustion in a heating furnace of a fuel with an oxidant including gaseous oxygen, said burner comprising: a burner head to which fuel and oxidant are supplied; at least two pairs of spaced apart nozzles provided in the burner head, wherein each pair of nozzles is defined by a separate fuel nozzle for supplying only fuel and a spaced apart separate oxidant nozzle for supplying only oxidant, wherein the separate and spaced apart fuel and oxidant nozzles have respective fuel and oxidant central axes and each of the fuel nozzle axes and each of the oxidant nozzle axes are spaced from each other and are parallel, wherein individual nozzles of the nozzle pairs are uniformly distributed over a burner head surface that fates into the furnace and within an outer circumference of the burner head, wherein the pairs of individual and spaced apart fuel only and individual and spaced apart oxidant only nozzles are uniformly alternately distributed in a circumferential direction relative to a burner head central axis and are uniformly radially distributed outwardly from a the burner head central axis, and wherein an oxidant nozzle is circumferentially positioned on each side of a fuel nozzle, wherein the fuel only nozzles of the at least two pairs of spaced apart nozzles are not concentric with a flow of oxidant.

10. A burner according to claim 9, wherein the burner head includes an additional nozzle that serves as a starting nozzle, the starting nozzle having respective concentric channels for fuel and oxidant, wherein the starting nozzle is supplied with fuel and oxidant until the furnace has reached the autoignition temperature of a mixture of the fuel and the oxidant.

11. A burner according to claim 9, wherein respective fuel nozzles and respective oxidant nozzles of the nozzle pairs are positioned along two respective mutually perpendicular diameters of the burner head.

12. A burner according to claim 9, wherein the discharge openings of the fuel and the oxidant nozzles are outlets of laval nozzles.

* * * * *